US007036246B2

(12) United States Patent
Otis et al.

(10) Patent No.: US 7,036,246 B2
(45) **Date of Patent: *May 2, 2006**

(54) SHOE WITH SLIP-RESISTANT, SHAPE-RETAINING FABRIC OUTSOLE

(75) Inventors: Jon Otis, Long Branch, NJ (US); Michael Safdeye, Brooklyn, NY (US); Michael Stein, Yardley, PA (US)

(73) Assignee: E.S. Origianals, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/177,073

(22) Filed: Jul. 7, 2005

(65) Prior Publication Data

US 2005/0241182 A1 Nov. 3, 2005

Related U.S. Application Data

(62) Division of application No. 10/176,430, filed on Jun. 19, 2002, which is a division of application No. 09/620,422, filed on Jul. 20, 2000, now Pat. No. 6,430,844.

(51) Int. Cl.
*A43B 23/28* (2006.01)
*A43B 1/02* (2006.01)

(52) U.S. Cl. ..... 36/59 R; 36/9 R; 36/11; 12/142 G; 12/146 B

(58) Field of Classification Search ..... 36/59 R, 36/9 R, 59 C, 11, 30 R; 12/142 G, 146 B
See application file for complete search history.

(56) References Cited

U.S. PATENT DOCUMENTS

| | | | |
|---|---|---|---|
| 384,483 | A | 6/1888 | Walters |
| 1,399,766 | A | 12/1921 | Grosjean |
| 1,587,377 | A | 6/1926 | Grosjean |
| 1,716,790 | A | 6/1929 | Mitchell |
| 1,811,803 | A | 6/1931 | Oakley |
| 2,121,678 | A | 6/1938 | Armor |
| 2,371,689 | A | 3/1945 | Gregg et al. |
| 2,391,564 | A | 12/1945 | Gregg |
| 2,400,487 | A | 5/1946 | Clark |
| 2,499,751 | A | 3/1950 | Hoza |
| 2,603,891 | A | 7/1952 | Cohn |
| 2,638,633 | A | 5/1953 | Root |
| 2,878,523 | A | 3/1959 | Hardy |
| 2,956,313 | A | 10/1960 | Choice |
| 3,016,631 | A | 1/1962 | Servin |
| 3,063,074 | A | 12/1962 | Scholl |

(Continued)

FOREIGN PATENT DOCUMENTS

| | | | |
|---|---|---|---|
| CN | 2244835 | Y | 1/1997 |

(Continued)

OTHER PUBLICATIONS

Agent's confirmation (with unverified translation) for Purchase Order No. 65113 to be delivered Mar. 26, 1999 for "Chenille Slipper, White TPR with Canvas Wrap Sole".

(Continued)

*Primary Examiner*—M. D. Patterson
(74) *Attorney, Agent, or Firm*—Kirschstein, et al.

(57) ABSTRACT

An outsole for a shoe, especially a house slipper, has an outer layer constituted of a fabric material, and a backing layer constituted of a shape-retaining, moldable material. The fabric layer and the backing layer are molded integrally together to provide the outsole with increased slip resistance, quieter usage and increased shape retention.

12 Claims, 3 Drawing Sheets

U.S. PATENT DOCUMENTS

| | | | |
|---|---|---|---|
| 3,085,294 | A | 4/1963 | Rosenbaum |
| 3,352,032 | A | 11/1967 | Yamaguchi |
| 3,668,056 | A | 6/1972 | Hayes, Jr. |
| 3,672,077 | A | 6/1972 | Coles |
| 3,676,542 | A | 7/1972 | Maltby |
| 3,765,978 | A | 10/1973 | Matt |
| 3,863,272 | A | 2/1975 | Guille |
| 3,888,026 | A | 6/1975 | Dassler |
| 3,972,973 | A | 8/1976 | Yardley et al. |
| 3,983,204 | A | 9/1976 | Opinsky et al. |
| 4,076,891 | A | 2/1978 | Yardley et al. |
| 4,120,477 | A | 10/1978 | Justamante |
| 4,122,574 | A | 10/1978 | Karalis |
| 4,245,406 | A | 1/1981 | Landay et al. |
| 4,356,643 | A | 11/1982 | Kester et al. |
| 4,519,148 | A | 5/1985 | Sisco |
| 4,561,140 | A | 12/1985 | Graham et al. |
| 4,616,430 | A | 10/1986 | McQuiggin |
| 4,649,586 | A | 3/1987 | Wu |
| 4,651,444 | A | 3/1987 | Ours |
| 5,053,179 | A | 10/1991 | Masui et al. |
| 5,106,445 | A | 4/1992 | Fukuoka |
| 5,396,675 | A | 3/1995 | Vincent et al. |
| 5,433,022 | A | 7/1995 | Lo et al. |
| 5,553,399 | A | 9/1996 | Strong |
| 5,667,738 | A | 9/1997 | Krajcir |
| 5,725,823 | A | 3/1998 | Finn et al. |
| 5,779,834 | A | 7/1998 | Pavelescu et al. |
| 6,035,554 | A | 3/2000 | Duncan |
| 6,149,852 | A | 11/2000 | Romanato et al. |
| 6,312,782 | B1 | 11/2001 | Goldberg et al. |
| 6,321,464 | B1 | 11/2001 | Oberg et al. |
| 6,430,844 | B1 | 8/2002 | Otis |
| 6,571,491 | B1 | 6/2003 | Safdeye et al. |

FOREIGN PATENT DOCUMENTS

| | | |
|---|---|---|
| CN | 2405451 Y | 11/2000 |
| DE | 4015138 | 11/1991 |
| FR | 2617382 | 1/1989 |
| TW | 83100172 | 1/1994 |
| TW | 83102659 | 3/1994 |

OTHER PUBLICATIONS

Color pictures of chenille slipper allegedly corresponding to Purchase Order No. 65113, slippers including a hang tag, and an image of the alleged hang tag including handwritten and unverified translations into a English.

Weisner Purchase Orders No. 11051 and No. 11052 for ladies clogs with open knit collar, Style No. 9122Navy and No. 9122Burg, respectively (Mar. 29, 1999).

Agent's confirmations showing Purchase Order No. 11051 and No. 11052 and the delivery date of Jul. 15, 1999 in English (2 pages).

New York Ruling D89353 on behalf of Weisner Products, Inc. (Apr. 21, 1999;2 pages).

New York E86018 on behalf of Weisner Products, Inc. (Sep. 13, 1999; 2 pages).

Copy of Complaint No. 4:03CV00774TCM.

Copy of Dority & Manning letter, Jun. 3, 2003.

SHOE WITH SLIP-RESISTANT, SHAPE-RETAINING FABRIC OUTSOLE

CROSS REFERENCE TO RELATED APPLICATIONS

This application is a division of U.S. patent application Ser. No. 10/176,430, filed Jun. 19, 2002, which in turn is a division of U.S. patent application Ser. No. 09/620,422, filed Jul. 20, 2000, now U.S. Pat. No. 6,430,844.

BACKGROUND OF THE INVENTION

1. Field of the Invention

The present invention generally relates to a shoe, especially a slipper, having a slip-resistant, shape-retaining outsole.

2. Description of the Related Art

A house slipper is typically designed for maximum comfort and is usually constructed of soft cushioned materials. The upper of the slipper is generally made with fabric-backed foam, and the lower of the slipper generally has foam inserts. The foam provides the desired comfort.

The outsole of many house slippers is usually entirely constituted of a fabric material. Although generally satisfactory, a slipper with an all-fabric outsole quickly loses its shape, thereby detracting from its appearance. Sometimes, a midsole board is inserted between the upper and the lower of the slipper. However, the midsole board is an extra component and renders the slipper less comfortable.

Other house slippers have outsoles made from rubber or plastic materials. Although generally satisfactory, a slipper with an all-rubber/plastic outsole is "noisier" during walking as compared to an all-fabric outsole and also tends to have less slip resistance.

SUMMARY OF THE INVENTION

Objects of the Invention

Accordingly, it is a general object of this invention to provide an outsole for a shoe, especially a slipper, that is shape-retaining even after prolonged usage, that is "quiet" in use, that has an increased slip resistance, and that does not require a midsole board.

Features of the Invention

In keeping with the above object and others which will become apparent hereafter, one feature of the present invention resides, briefly stated, in a shoe having an upper, a lower attached to the upper, and an outsole attached to the lower, the outsole having an outer layer constituted of a fabric material and a backing layer constituted of a shape-retaining material, the outer and backing layers being integrally connected with each other, for example, by being molded in Situ. In accordance with this invention, the outer fabric layer provides the increased slip resistance and the quieter usage, whereas the shape-retaining, molded backing layer provides the increased shape retention.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
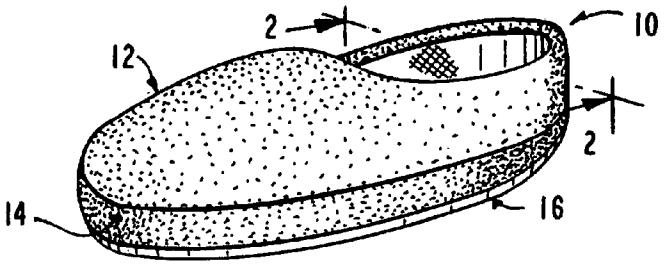
FIG. 1 is a perspective view on a reduced scale of a slipper having an outsole in accordance with this invention.

Reference numeral 10 in FIG. 1 generally identifies a shoe, especially a slipper, having an upper 12, a lower 14 attached to the upper 12, and an outsole 16 attached to the lower 14.

Figure 2:
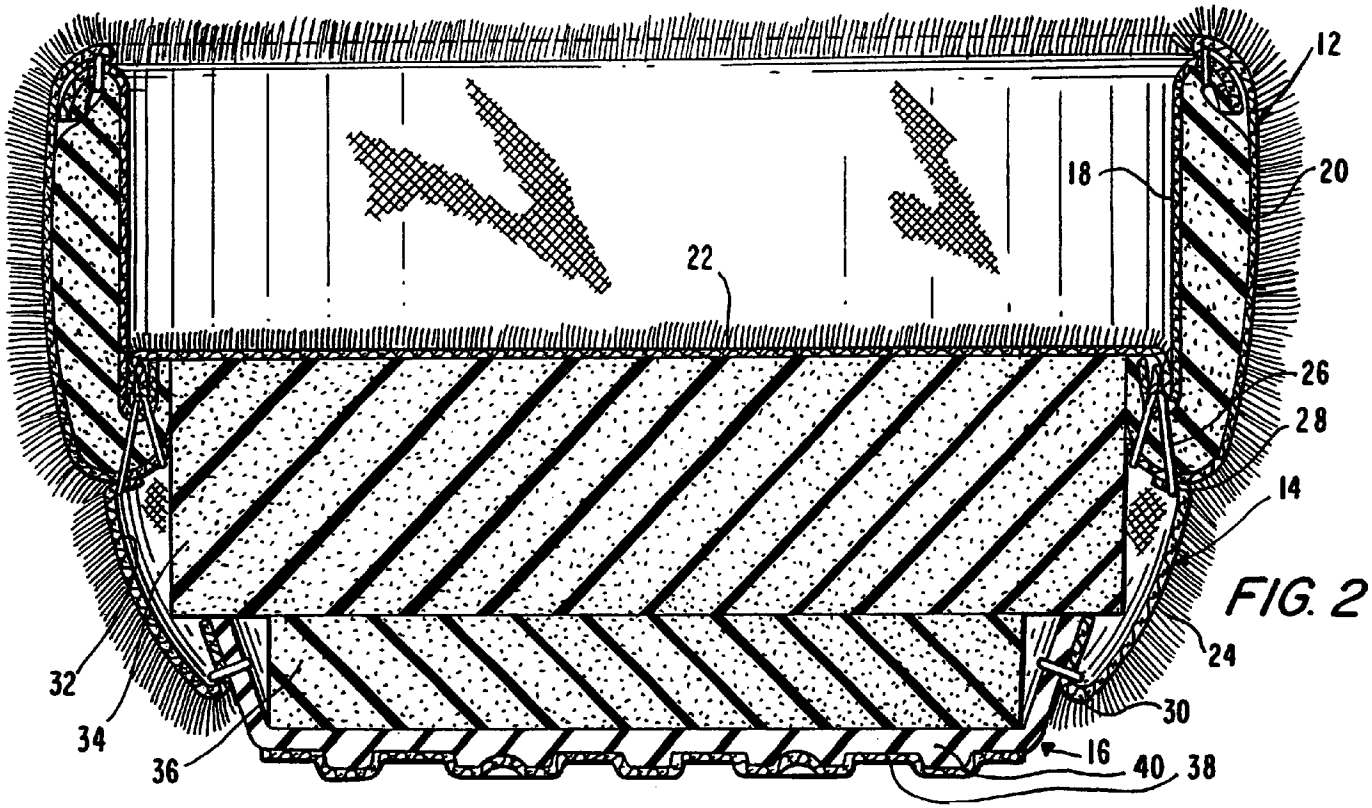
FIG. 2 is an enlarged, sectional view taken on line 2-2 of FIG. 1.

As best seen in FIG. 2, the upper 12 includes a soft cushioned material, such as a fabric-backed foam 18 at the interior of the shoe for resiliently engaging a wearer's foot, and an exterior cover, such as a high pile fabric 20, stitched to the fabric-backed foam 18. The foam 18 and high pile fabric 20 are merely exemplary materials since many other materials can be used to make the upper.

As also seen in FIG. 2, the lower 14 includes a base material 22 at the interior of the shoe for engaging the wearer's foot, and a skirt material 24 at the exterior of the shoe. The base and skirt materials are typically constructed of a fabric, and preferably may be made of the same material as the high pile fabric 20. An upper portion 28 of the skirt material is stitched to a lower portion of the upper, and is also stitched to opposite sides of the base material 22 along a peripheral seam 26. A lower portion 30 of the skirt material is stitched to the outsole 16, thereby forming an internal compartment 32 between the outsole 16 and the base material 22. One or more foam inserts 34, 36 are inserted into the compartment 32 to provide cushioning for the wearer's foot. Again, the described choice of materials for the lower is merely exemplary, since many other materials can be used to make the lower.

In accordance with this invention, the outsole 16 includes an outer layer 38 constituted of a thin, flexible, fabric sheet material, for example, a knitted or woven cloth, and a backing layer 40 constituted of a shape-retaining material, for example, a rubber or a plastic material. The fabric layer 38 and the backing layer 40 are integrally connected together, for example, by being molded in situ in a common mold.

Figure 3:
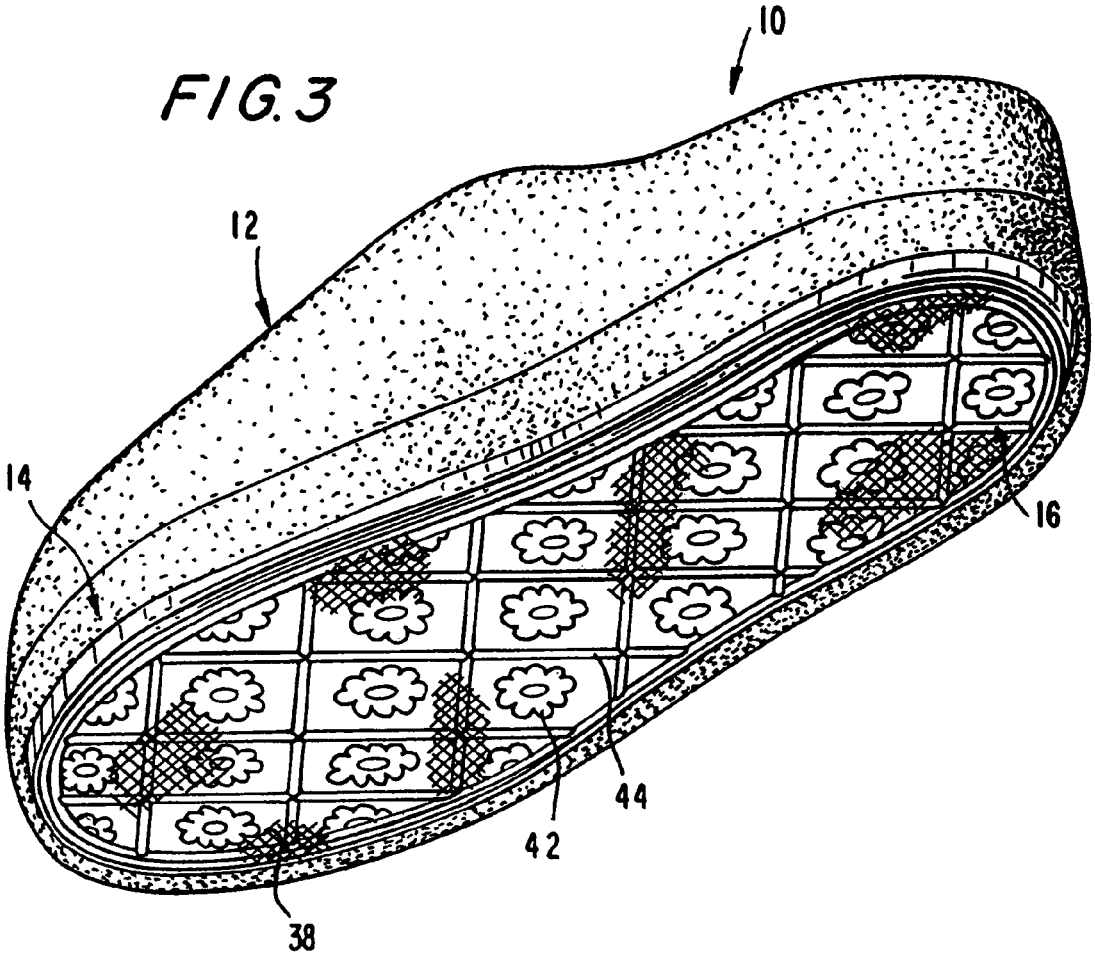
FIG. 3 is a perspective view of the slipper of FIG. 1 as seen from below.

The backing layer preferably has a raised and/or recessed tread pattern, as exemplified by the flower-like decorations 42 and diagonal ribs 44 visible on the underside of the shoe in FIG. 3. The fabric layer 38 closely conforms to the pattern and, indeed, follows the contour thereof. Other tread patterns, are, of course, contemplated by this invention.

Also contemplated is the application of graphic markings on the fabric layer 38. The graphic markings are applied in any known manner, for example, silk screening or printing. Virtually any markings can be employed.

Figure 4:
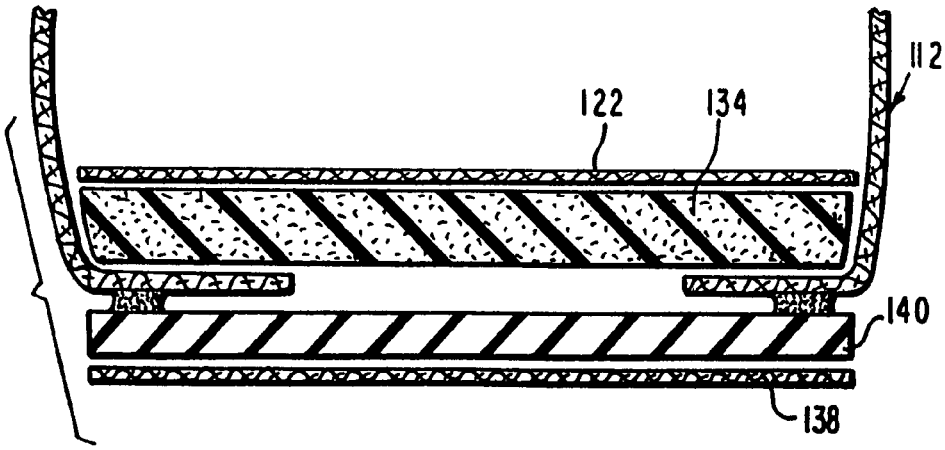
FIGS. 4, 5 and 6 are exploded sectional views of alternate embodiments in accordance with this invention.

Alternate shoe constructions are depicted in the remaining drawings. FIG. 4 depicts an outer fabric layer 138 integrally connected to a backing layer 140. An upper 112 consisting of a flexible fabric is attached to the backing layer 140 by an adhesive as shown, or by stitching. A base material 122 overlies a foam insert 134 and is attached to the upper 112, again by using an adhesive or stitching.

Figure 5:
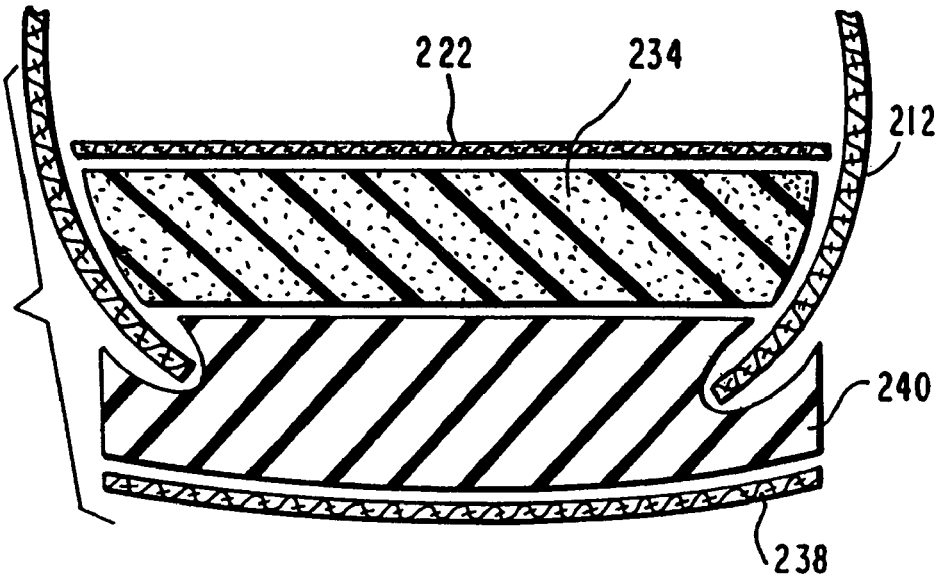

FIG. 5 depicts an outer fabric layer 238 integrally connected to a backing layer 240. An upper 212 consisting of a flexible fabric is attached to the backing layer 240 not through another fabric as in FIG. 2, and not by an adhesive as in FIG. 4, but instead, is inserted into the same mold in which the backing layer 240 and the fabric layer 238 are molded. The upper 212 is injection molded into the backing layer 240. A base material 222 overlies a foam insert 234 and is attached to the backing layer 240 by using an adhesive or stitching.

Figure 6:
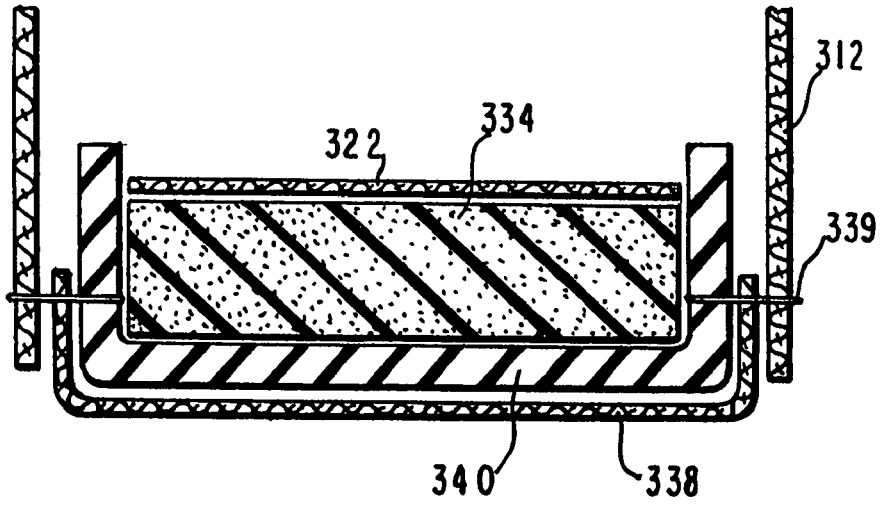

FIG. 6 depicts an outer fabric layer 338 integrally connected to a backing layer 340. An upper 312 consisting of a flexible fabric is attached to the combination of the backing layer 340 and the fabric layer 338 by stitching 339. A base material 322 overlies a foam insert 334 and is inserted into a well of the backing layer 340 and is secured therein by using an adhesive or stitching.

Other variations are possible. In each case, however the outer fabric layer is integrally connected to the backing layer.

It will be understood that each of the elements described above, or two or more together, also may find a useful application in other types of constructions differing from the types described above.

While the invention has been illustrated and described as embodied in a shoe with slip-resistant, shape-retaining fabric outsole, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A shoe, comprising a) an outsole having an outer surface predominantly constituted of a fabric material integrally molded onto a moldable backing material, the outsole having an outer periphery, and the fabric material terminating short of the outer periphery of the outsole; and b) an upper connected to the outsole at the outer periphery of the outsole.

2. The shoe of claim 1, wherein the fabric material is a sheet of fabric in direct non-adhesive contact with the backing material.

3. The shoe of claim 1, wherein the outer periphery of the outsole is a bare region devoid of the fabric material, and wherein the upper is non-moldably connected to the bare region.

4. The shoe of claim 1, wherein the fabric material is a single sheet of woven material, and wherein the moldable material is one of a rubber and a plastic material.

5. The shoe of claim 1, wherein the backing material is embedded in, and terminates short of, the outer surface of the outsole.

6. The shoe of claim 1, wherein the outsole has a compartment, and a cushioning element non-moldably attached to the outsole and located in the compartment.

7. A shoe outsole, comprising:

a) a fabric material predominantly constituting an outer surface of the outsole;

b) a moldable backing material onto which the fabric material is integrally molded; and c) an outer periphery of the outsole of which the fabric material terminates short.

8. The outsole of claim 7, wherein the fabric material is a sheet of fabric in direct non-adhesive contact with the backing material.

9. The outsole of claim 7, wherein the outer periphery of the outsole is a bare region devoid of the fabric material.

10. The outsole of claim 7, wherein the fabric material is a single sheet of woven material, and wherein the moldable material is one of a rubber and a plastic material.

11. The outsole of claim 7, wherein the backing material is embedded in, and terminates short of, the outer surface of the outsole.

12. The outsole of claim 7, and a compartment, and a cushioning element non-moldably attached to the outsole and located in the compartment.

* * * * *

UNITED STATES PATENT AND TRADEMARK OFFICE

CERTIFICATE OF CORRECTION

PATENT NO. : 7,036,246 B2
APPLICATION NO. : 11/177073
DATED : May 2, 2006
INVENTOR(S) : Jon Otis, Michael Safdeye and Michael Stein It is certified that error appears in the above-identified patent and that said Letters Patent is hereby corrected as shown below:

TITLE PG, ITEM (73)
Please correct the assignee to read E.S. ORIGINALS, INC. Currently "Originals" has an extra "a" (Origianals).

Signed and Sealed this

Fifth Day of September, 2006

JON W. DUDAS
*Director of the United States Patent and Trademark Office*